United States Patent [19]

Anderson

[11] Patent Number: 4,597,427

[45] Date of Patent: Jul. 1, 1986

[54] SHIPPING CLIP FOR LOCKING THE SLATS ON A VENETIAN BLIND ASSEMBLY AGAINST TILTING

[75] Inventor: Richard N. Anderson, Owensboro, Ky.

[73] Assignee: Hunter Douglas Inc., Totowa, N.J.

[21] Appl. No.: 601,694

[22] Filed: Apr. 18, 1984

[51] Int. Cl.[4] ..... E06B 3/32

[52] U.S. Cl. ..... 160/107; 206/325

[58] Field of Search ..... 206/45.14, 325, 326, 206/387, 807; 248/544; 160/107, 168, 178, 236, DIG. 16

[56] References Cited

U.S. PATENT DOCUMENTS

| | | | |
|---|---|---|---|
| 2,120,593 | 6/1938 | Reynolds | 206/326 |
| 2,343,813 | 3/1944 | Simon | 160/DIG. 16 |
| 3,129,471 | 4/1964 | Johnson et al. | 160/107 |
| 3,153,819 | 10/1964 | Bond | 160/107 |
| 4,056,244 | 11/1977 | Matsutsuka | 206/387 |
| 4,300,674 | 11/1981 | Davet | 206/45.14 |
| 4,381,836 | 5/1983 | Rivkin et al. | 206/387 |
| 4,475,706 | 10/1984 | Anderson | 248/544 |
| 4,480,674 | 11/1984 | Anderson | 160/107 |

*Primary Examiner*—Joseph Man-Fu Moy
*Assistant Examiner*—David T. Fidei
*Attorney, Agent, or Firm*—Pennie & Edmonds

[57] ABSTRACT

The disclosure relates to a shipping clip for use in a venetial blind assembly where the assembly includes an operable element moveable between a slat open and a slat closed position and which is operatively connected to a tilt mechanism for tilting slats of the blind assembly. The assembly also includes a mounting or guide means for mounting and guiding the operable element on a part of the window unit, for example, a glazing or frame member of the window unit. The shipping clip has locking means thereon adapted to engage said operable element in a slat fully open position to lock movement of the operable movement with respect to the mounting or guide means. The clip is applied to the operable element at the factory before shipping and is removed after the blind assembly has been installed at a building site.

8 Claims, 4 Drawing Figures

FIG. 1
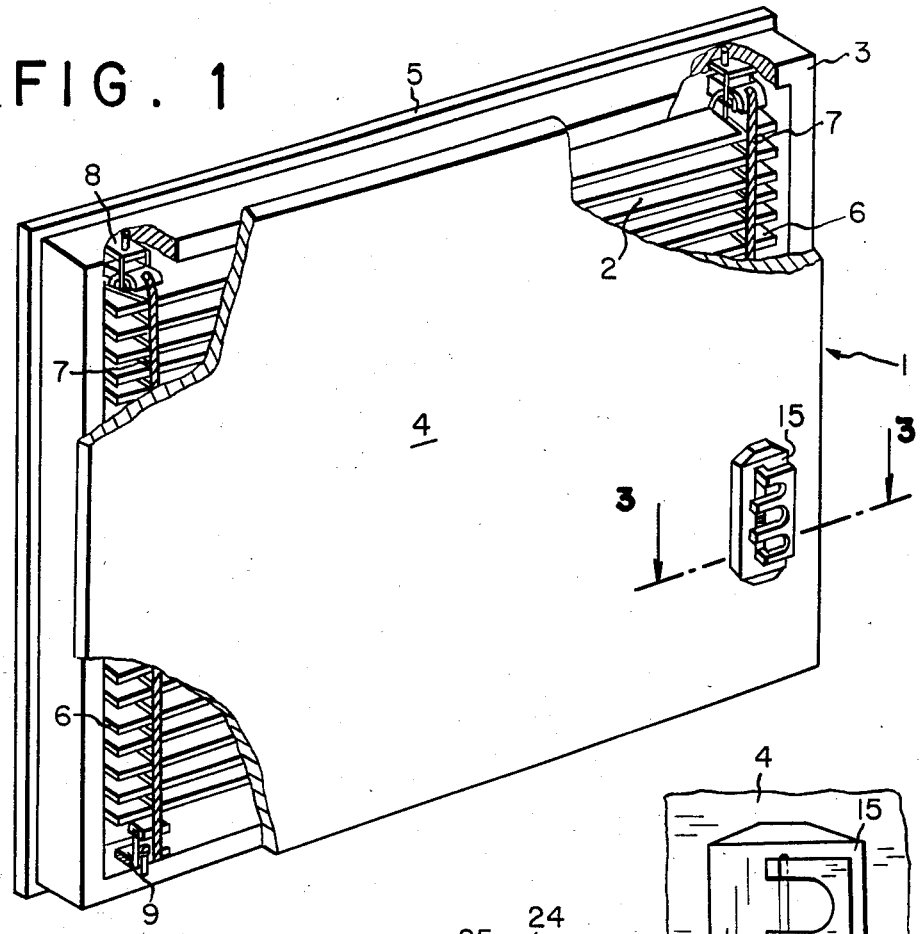
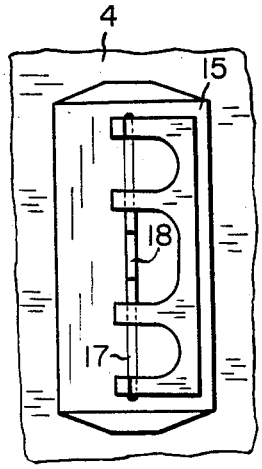
FIG. 2
FIG. 4
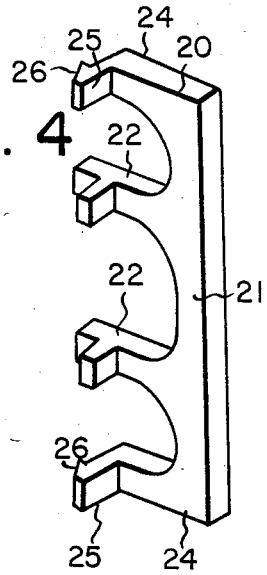
FIG. 3
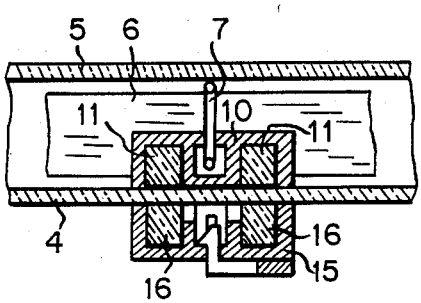

SHIPPING CLIP FOR LOCKING THE SLATS ON A VENETIAN BLIND ASSEMBLY AGAINST TILTING

FIELD OF THE INVENTION

This invention relates to a shipping clip for locking the slats of a venetian blind assembly against tilting during shipment and/or installation of the assembly.

BACKGROUND OF THE INVENTION

Venetian blind assemblies that are assembled at a factory and shipped for installation at a job site are often damaged due to jolts or shocks received during shipping or during installation of the assembly in a building. Such damage can be very costly to repair particularly if the assembly is part of a hermetically sealed window unit. Damage to such units often can only be repaired at the factory where the unit was manufactured necessitating returning the unit to the factory, and where the blind assembly was damaged during installation, removing the complete sealed unit from the building, replacing it with a new unit, and returning the damaged unit to the factory.

Damage to the blind assembly may occur when the slats of the blind assembly are in a completely closed position, and because of a shock or jolt, the edges of some of the slats may become jammed or locked between glazings of the unit and insulation or retainer strips surrounding the edges of the glazing. This results in all or some of the slats being permanently locked into a closed or partially closed position.

Even if the units are shipped and installed with the slats in a fully open position, the slat tilting means associated with the unit may inadvertently be moved to a closed position thus putting the assembly in a state where it may be damaged.

It is therefore an object of my invention to provide for a locking clip that may be applied to an operable element of a slat tilting mechanism whereby the slats may be locked in a fully open position during shipping and installation.

It is a further object of the invention to provide for a locking clip that may be economically manufactured and discarded after a blind assembly has been installed at a building site.

GENERAL DESCRIPTION OF THE INVENTION

Broadly a shipping clip according to my invention is adapted for use in a venetian blind assembly where the assembly includes an operable element movable between a slat open and a slat closed position and which is operatively connected to a tilt mechanism for tilting slats of the blind assembly. The assembly also includes a mounting or guide means for mounting and guiding the operable element on a part of a window unit, for example, a glazing or a frame member of the window unit. The shipping clip has locking means thereon adapted to engage said operable element in a slat fully open position to lock movement of the operable element with respect to the mounting or guide means. The clip is applied to the opperable element at the factory before shipping and is removed after the blind assembly has been installed at a building site.

Preferably the clip is used in an assembly where the operable element is movable in a linear direction and includes a linearly extending slot therein which is engaged by the guide member whch extends through the slot and which is fixed to a glazing or to a frame member. The clip includes two linearly spaced stops which are adapted to engage opposite ends of the guide element which extends through the slot. The clip also includes engagement means which engage the ends of the slot with the result that when the stops engage the fixed guide means, and when the engagement means engage the ends of the slot, the movable operable element is locked against movement with respect to the guide means.

The stop means preferably comprises spaced arms which extend from a body portion of the operable element substantially perpendicular to the slot when the clip is installed. The engagement means includes further spaced arms on the ends of the body portion extending parallel to the arms having the stop means. These further arms have depending finger portions which extend into the slot so as to engage the ends thereof. The clip is retained on the operable element by barbs on the end of the finger portions which are adapted to engage a bottom edge of the slot of the operable element.

The arms containing the stop means are symmetrically positioned with respect to the further arms containing the engagement means so that the guide means will be positioned in the center of the slot by the stop means and which corresponds to a position of the operable element where the slats of the blind assembly will be in the fully open horizontal position.

The operable element and guide means are capable of being reversed. That is the member having the slot could be the member fixed to the glazing or frame member in which event it would become the guide means and the member extending through the slot would then be operatively connected to the tilt mechanism. In either event the clip serves to lock the operable member for movement relative to the guide member.

The shipping clip is particularly adaptable for use where the movable member includes a magnet and is slidable on a surface of a glazing and magnetically coupled to a second magnet slidable on an opposite surface of the glazing with the second magnet in turn forming part of a tilt mechanism. This arrangement is used with hermetically sealed window units.

The cap itself is preferably molded from a plastic material such that the barbs retaining the clip in position may be easily broken off or snapped out of the slot after installation of a window unit.

BRIEF DESCRIPTION OF THE DRAWINGS

FIG. 1 is a perspective partially broken view of a hermetically sealed window unit having a shipping clip according to the invention locking a tilting mechanism against tilting movement;

FIG. 2 is an enlarged front view of a portion of FIG. 1 illustrating a shipping clip according to the invention applied to an operable element of a tilt mechanism;

FIG. 3 is an enlarged sectional view of FIG. 1 taken along lines 3—3; and, FIG. 4 is a perspective view of tne shipping clip of FIG. 1.

DETAILED DESCRIPTION OF THE PREFERRED EMBODIMENT

Referring to FIG. 1 there is illustrated a hermetically sealed window unit 1 having a venetian blind assembly 2 therein. The window comprises a frame 3 having a glazing 4 on one side thereof and a further glazing 5 on the opposite side as shown in FIG. 3.

The venetian blind assembly 2 has a plurality of slats 6 supported by ladder tapes 7 which extend between top pivot members 8 and bottom pivot members 9 pivotally mounted to upper and lower portions of the frame 3. An operating element 10 containing magnets 11 slides on an inner surface of the glazing 4 and is connected to one of the ladder tapes 7. The operating element 10, magnet 11, ladder tapes 7 and upper and lower pivot members 8 and 9 all form part of a tilt mechanism which operates to tilt the slats 6 as the operating element 10 slides vertically on the inner surface of the glazing.

The operating element 10 is magnetically coupled to an operable element 15 comprising a housing containing magnets 16. Operable element 15 in turn has a linearly extending slot 17 therein through which a guide member 18 extends. Guide member 18 in turn is fixed to the exterior side of the glazing 4 such that it guides the element 15 in a linear direction as it slides on the glazing.

The shipping clip 20 as shown in FIG. 4 comprises a body portion 21 having a stop means in the form of two arms 22 which are adapted to engage two opposite sides of tne guide member 18 as shown in FIG. 2. The body portion also has engagement means in the form of two further arms 24 each of which has a depending finger 25 adapted to extend into the slot 17 and engage the ends thereof.

As shown the arms 22 are symmetrically spaced with respect to the body portion such that the guide means will be positioned midway along the length of the slot when the clip is in position on the operable element. This center slot position of the operable element corresponds to the slat fully open position with the slats being in the horizontal position. When held or locked in this position, the side edges of the bottom and top slats will be prevented from catching or snagging with insulation strips engaging top and bottom edges of the glazing.

The clip is retained on the operable element by retaining means in the form of barbs 26 on the ends of the finger portions 25 and which are adapted to engage a bottom edge of the slot in the operable element 15.

The clip itself may conveniently be molded from plastic which will give the clip a degree of flexibility so that it may be easily snapped into and out of engagement with the slot.

While the clip has been shown installed with the operable element and guide means applied to a glazing, they could in the alternative be applied to a section of the frame of a window unit.

I claim:

1. A shipping clip for locking an operable element of a venetian blind assembly during shipment and/or installation of the assembly, and where the assembly includes said operable element being linearly movable and operatively connected to a tilt mechanism for tilting slats of the assembly and a guide means for guiding the operable element in a linear direction, said shipping clip having locking means thereon adapted to prevent relative movement between said operable movement and said guide means, and said operable element having a linearly extending slot therein and said guide means having a fixed portion extending through said slot to guide the element during movement thereof, said locking clip having two linearly spaced stops thereon adapted to engage opposite ends of said fixed portion extending through said slot, and having engagement means thereon adapted to engage the ends of said slot.

2. A shipping clip according to claim 1 having in addition retention means adapted to hold the clip into engagement with said slot.

3. A shipping clip according to claim 2 including a body portion and wherein each said stop comprises an arm extending from said body portion in a direction substantially perpendicular to the linearly extending slot and over an upper surface of said operable element.

4. A shipping clip according to claim 3 wherein an engagement means engaging an end of the slot comprises a further arm extending from said body portion in a direction substantially perpendicular to the slot and having a depending finger portion at one end extending into said slot to engage an end of said slot.

5. A shipping clip according to claim 4 wherein said retention means comprises a barb adapted to engage a bottom edge of the slat of said operable member.

6. A shipping clip according to claim 5 wherein said barb is on the end of a finger portion.

7. A shipping clip according to claim 4 wherein said arms are positioned symmetrically on said body portion whereby said guide means will be engaged by the stops in the moddle of said slot.

8. A shipping clip for locking the slats of a venetian blind assembly against tilting during shipment of the assembly and where the assembly includes a glazing, a linearly movable operable element slidable on one surface of said glazing magnetically coupled to a tilt mechanism adjacent an opposite surface of said glazing from said one surface for tilting said slats with said element having a linearly extending slot therein, a guide means affixed to said one surface and extending into said slot whereby said operable element may be moved with respect to said guide means in a linear direction parallel to said slot, said clip comprising a body portion adapted to overlie said operable element on one side of said slot, two arms extending from said body portion adapted to engage opposite sides of said guide means extending through said slot, and a further arm on each end of said body portion having a depending finger on a free end thereof adapted to engage an end of the slot to prevent movement of the operable element with respect to the guide means.

* * * * *